US005177397A

United States Patent [19]

Nagasawa et al.

[11] Patent Number: 5,177,397

[45] Date of Patent: Jan. 5, 1993

[54] DISCHARGE LAMP ASSEMBLY WITH INSULATING TUBULAR MEMBER AND METAL BAND AROUND PINCH SEAL

[75] Inventors: Masakazu Nagasawa; Nobuo Ohkawai; Goichi Oda; Masaya Shidoh; Shinichi Irisawa; Yukio Wakimizu, all of Shizuoka, Japan

[73] Assignee: Koito Manufacturing Co., Ltd., Tokyo, Japan

[21] Appl. No.: 458,464

[22] Filed: Dec. 28, 1989

[30] Foreign Application Priority Data

Dec. 28, 1988 [JP] Japan ..... 63-335427
Oct. 20, 1989 [JP] Japan ..... 1-272954

[51] Int. Cl.[5] ..... H01J 61/30
[52] U.S. Cl. ..... 313/318; 439/612
[58] Field of Search ..... 313/318, 317, 638, 639, 313/276; 439/611, 612, 619

[56] References Cited

U.S. PATENT DOCUMENTS 3,760,217 9/1973 Martin et al. ..... 313/276
4,126,371 11/1978 Puhak ..... 313/318
4,482,842 11/1984 Fujimura et al. ..... 313/639
4,631,446 12/1986 English et al. ..... 313/318
4,743,803 5/1988 Lanese et al. ..... 313/318
4,823,049 4/1989 Sanders et al. ..... 313/318
4,853,597 8/1989 Heinal et al. ..... 313/638
4,879,491 11/1989 Hirozumi et al. ..... 313/318
5,059,855 10/1991 Irisawa et al. ..... 313/318

*Primary Examiner*—Donald J. Yusko
*Assistant Examiner*—John Giust
*Attorney, Agent, or Firm*—Sughrue, Mion, Zinn, Macpeak & Seas

[57] ABSTRACT

An electric discharge lamp assembly including a lamp bulb having two lead wires, and a lamp base supporting two lead support members with respective tip ends thereof being connected respectively to the lead wires of the lamp bulb. One of the lead support members is formed to have an elongated length and is covered by an insulating tubular member substantially. The rear end portion of the insulating tubular member is fitted on and secured to a tubular portion of the lamp base which portion is integrally formed with the lamp base. Whereby the electric discharge between the two support members is prevented effectively, and the insulating tubular member is secured to the lamp base reliably.

6 Claims, 15 Drawing Sheets

DISCHARGE LAMP ASSEMBLY WITH INSULATING TUBULAR MEMBER AND METAL BAND AROUND PINCH SEAL

FIELD OF THE INVENTION

The present invention relates to an electric discharge lamp assembly and, particularly to a support mechanism in the electric discharge lamp assembly for supporting a lamp body.

DESCRIPTION OF PRIOR ART

Various proposals have been made with respect to the electric discharge lamp and, recently, it is required to use the lamp as an headlight lamp of an automobile. The lamp is required to have a reduced size as compared with a high capacity. Since the electric discharge lamp is supplied with a high voltage there is a problem to avoid an electric discharge between such as terminals and the like, particularly between two supporting members which project from a lamp base and are respectively connected to electrodes of a glass bulb.

The present invention aims to provide a novel electric discharge lamp assembly solving above described problems.

SUMMARY OF THE INVENTION

According to the invention, there is provided an electric discharge lamp assembly including a lamp bulb having two lead wires, and a lamp base supporting two lead support members with respective tip ends thereof being connected respectively to the lead wires of the lamp bulb, wherein one of the lead support members is formed to have an elongated length and is covered by an insulating tubular member substantially, with the rear end portion of the tubular member being fitted on and secured to a tubular portion which is formed integrally to and projecting from the front surface of the lamp base, whereby the electric discharge between the two support members is prevented reliably and the insulating tubular member is secured to the lamp base reliably.

According to further feature of the present invention, a metal band is wound around one of pinch seal portions of the lamp bulb and is secured to the long lead support member and to one of the lead wires associated with the one pinch seal portion.

BRIEF DESCRIPTION OF THE DRAWINGS

Further objects and effects of the invention will become apparent from the following detailed description in conjunction with the drawings, in which.

DETAILED DESCRIPTION OF PREFERRED EMBODIMENTS

FIG. 1 through FIG. 6 show a first preferred embodiment of the present invention as applied on a metal halide electric discharge lamp assembly 1.

Figure 1:
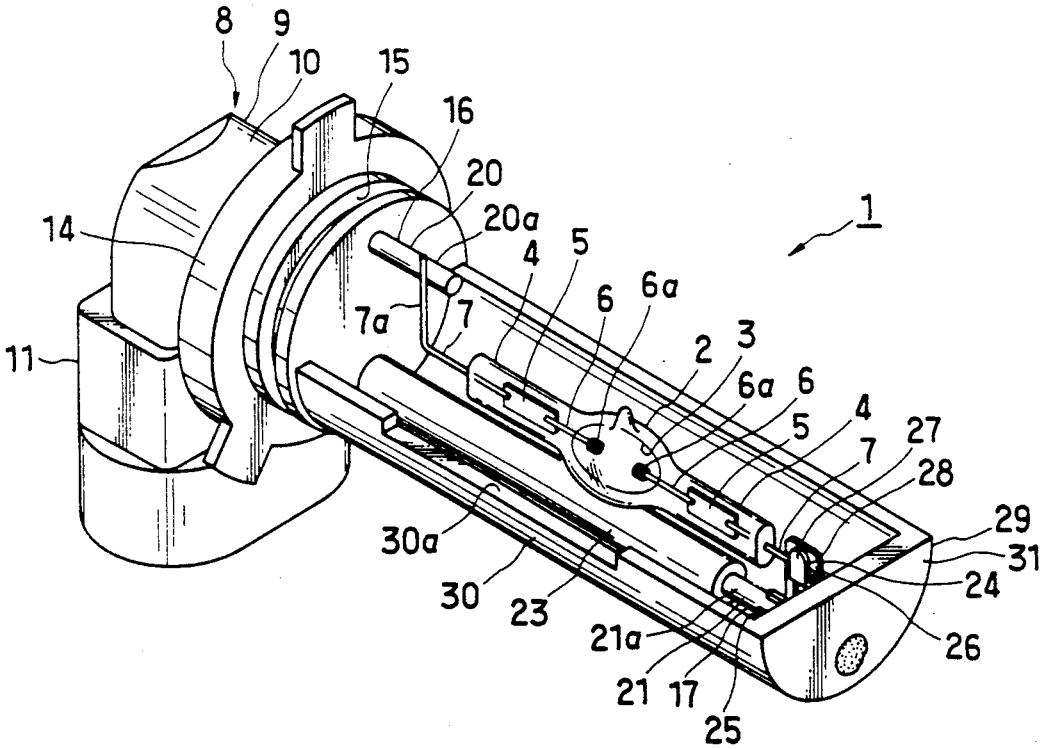
FIG. 1 is a perspective view of an electric discharge lamp assembly according to a first embodiment of the present invention.

In the specification, the wording "front" means the direction upward in FIG. 1 and "rear" means the direction downward in FIG. 1.

Discharge Bulb

Shown at 2 is a metal halide discharge lamp, which includes a glass tube with the opposite end portions being sealed by pinch seal portions 4 and 4 defining therebetween a central discharge space 3. Shown at 5 and 5 are metal foils enclosed respectively in the pinch seal portions 4 and 4, and at 6 and 6 are electrodes with one ends 6*a* and 6*a* projecting into the discharge space 3 to constitute the discharge electrodes. The other portions of the electrodes 6 and 6 are embedded in the pinch seal portions 4 and 4 respectively and the metal foils 5 and 5 are connected respectively to the electrodes 6 and 6.

Lead wires 7 and 7 are connected respectively to the metal foils 5 and 5 and project respectively from the opposite ends of the pinch seal portions 4 and 4.

Lamp Mounting Means

Shown at 8 is a lamp mounting means for supporting the lamp 2, and comprises a lamp base 9 preferably formed of a synthetic resin material, two support members 20 and 21, a shade 29 formed of such as a ceramic and the like, and a metal-made support member 24 and the like.

Lamp Base

The lamp base 9 has a generally laid down L-shaped form as viewed from the side, with a lamp holding portion 10 extending in the fore and aft directions and a connector potion 11 being integrally formed with the lamp holding portion 10 and extending downward from the rear end of the portion 10. Preferably, the lamp base 9 is formed of P.P.S. resin (Polyphenilen Sulfide) which can resist a high voltage.

The connector portion 11 has a recess 12 opening in the downward direction and having a generally oval shape with the major axis extending in the left and right directions, further, the recess 12 has a smaller upper portion 12*a* and a larger lower portion 12*b*. A partition wall 13 is formed in the upper portion 12*a*.

Shown at 14 is a flange formed on the outer surface of the lamp holding portion 10, and at 15 is an annular groove for receiving a packing member.

Terminal Member

Shown at 16 and 17 are terminal members formed of a electric conductive material and comprise respectively portions 18 and 19 embedded in the lamp base 9, and support members 20 and 21 projecting from the front end of the lamp holding portion 10 and being integrally formed with the embedded portions 18 and 19.

The embedded portions 18 and 19 respectively comprise horizontal portions 18*a* and 19*a* extending in fore and aft directions, vertical portions 18*b* and 19*b* extending in the vertical directions and intermediate portions 18*c* and 19*c* connecting respectively the rear ends of the horizontal portions with corresponding upper ends of the vertical portions respectively.

The support members 20 and 21 respectively consist of horizontal portions 20*a* and 21*a* extending in fore and aft directions and vertical portions 20*b* and 21*b* which extend in the vertical directions. The length of the portion 20*a* is about $\frac{1}{4} \sim 1/5$ of that of the portion 21*a*. The vertical portion 20*b* extends downward from the rear end of the portion 20*a*, and the portion 21*b* extends upward from the rear end of the portion 21*a*.

Figure 2:
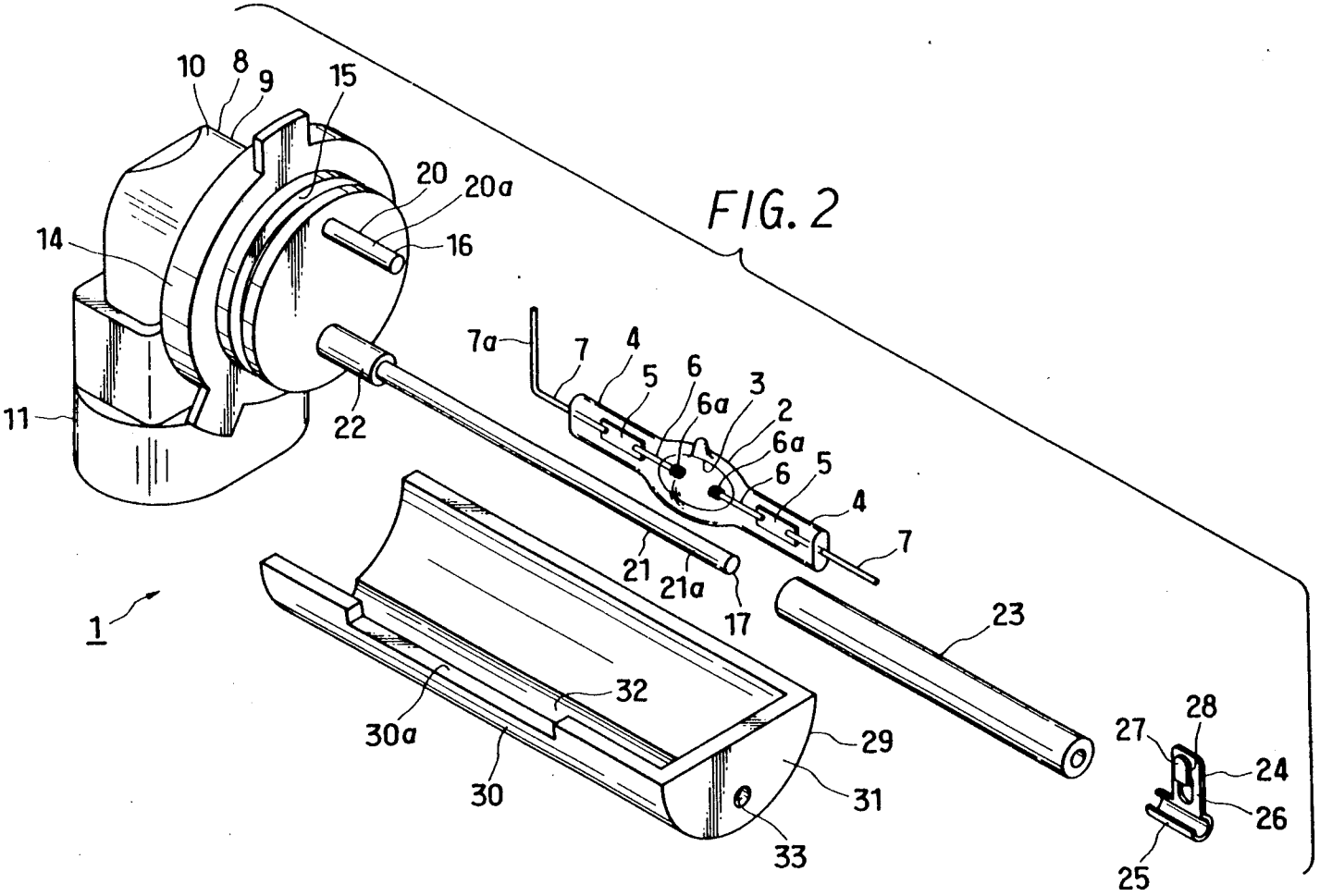
FIG. 2 is an exploded perspective view of the lamp assembly of FIG. 1.
Figure 3:
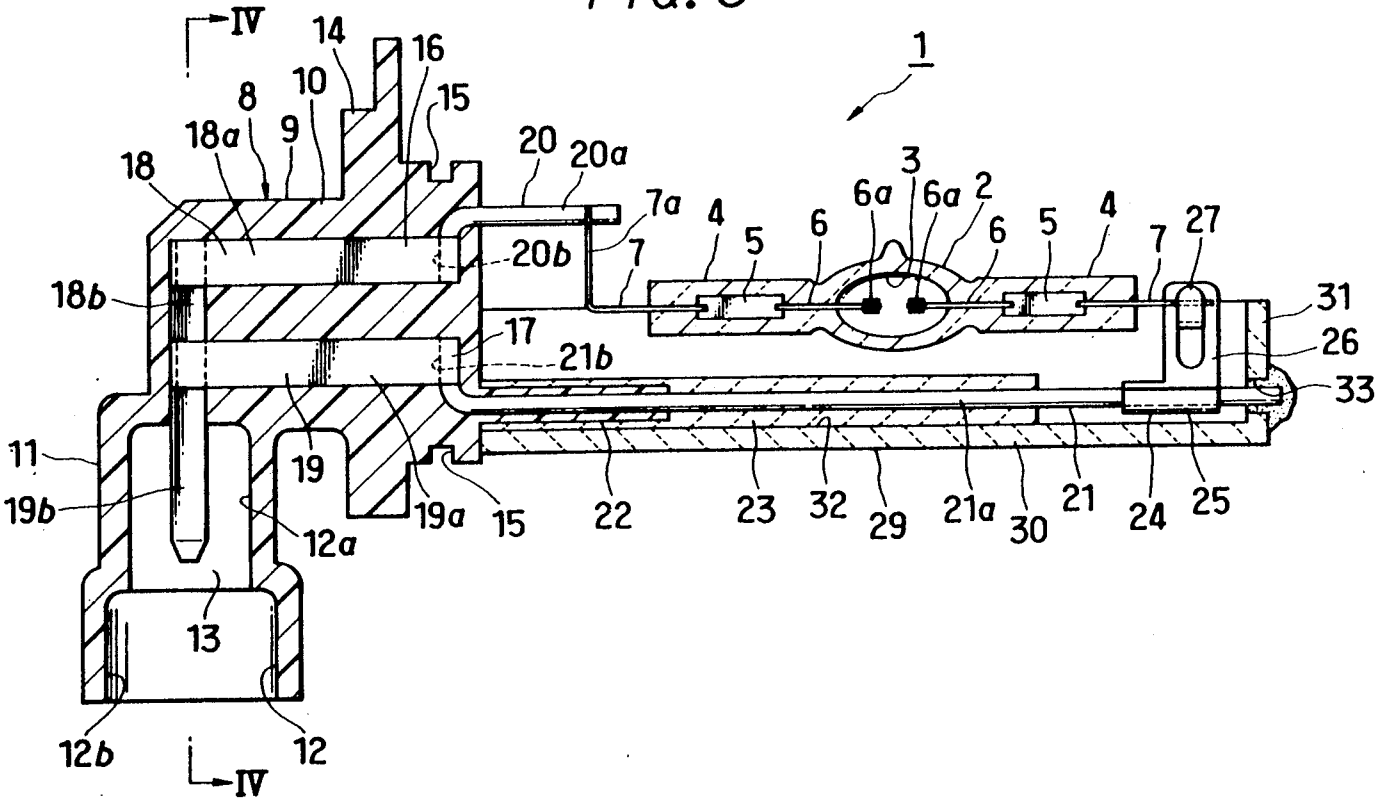
FIG. 3 is a longitudinal section view of FIG. 1.
Figure 4:
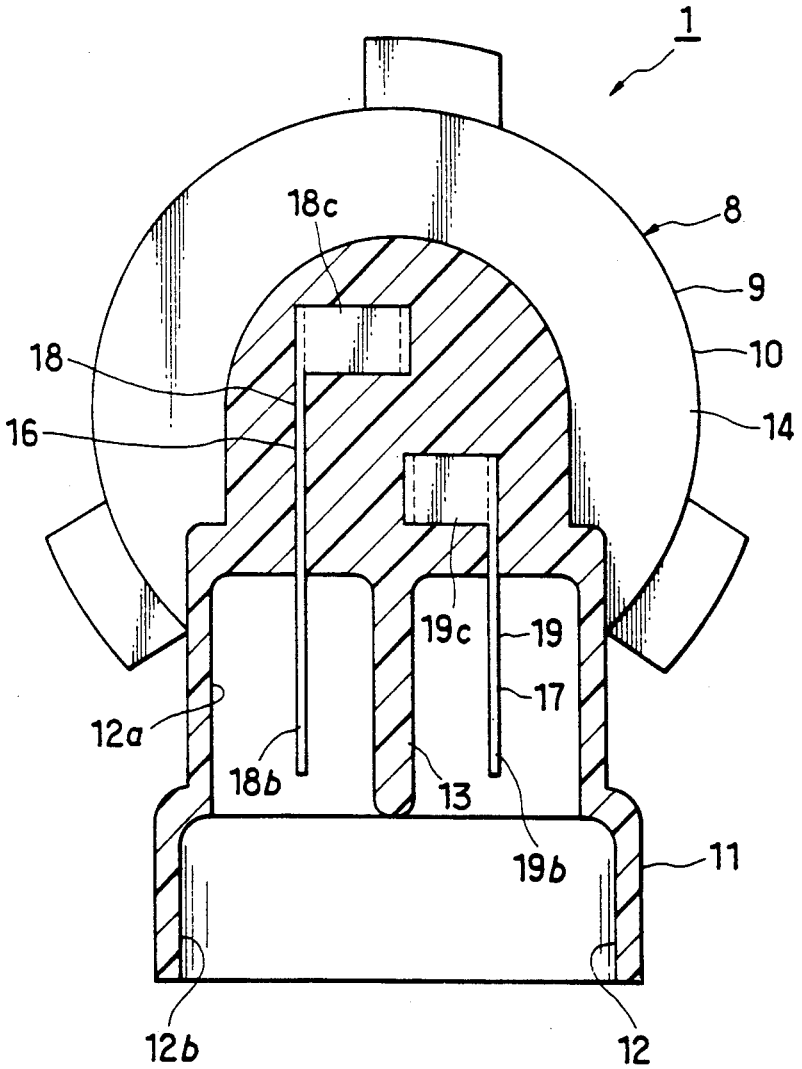
FIG. 4 is an enlarged section view taken along line IV—IV in FIG. 3.

The terminals 16 and 17 are integrally formed with the lamp base 9 by such as insert forming process. Although the major portions of the embedded portions 18 and 19 are embedded in the lamp base 9, the lower end portions of the vertical portions 18*b* and 19*b* and major portions of the horizontal portions 20*a* and 21*a* respectively project out of the lamp base 9. The horizontal portions 18*a* and 19*a* of the embedded portions 18 and 19 are generally vertically aligned and spaced as shown in FIG. 2, and the vertical portions 18*b* and 19*b* are horizontally spaced as shown in FIG. 4.

Shown at 22 is a tubular portion integrally formed on the front surface of the lamp holding portion 10 of the lamp base 9 so as to cover the rear end portion of horizontal portion 21*a* of the longer support member 21. The length of the tubular portion 22 projecting from the front surface of the lamp holding portion 10 is larger than that of the horizontal portion 20*a* of the short support member 20.

Insulating Tube

Shown at 23 is an insulating tube formed of a glass or a ceramic material and is fitted on the horizontal portion 21*a* of the longer support member 21. The rear end portion of the insulating tube 23 is fitted on the tubular portion 22. The insulating tube 23 is secured to the tubular portion 22 and to the horizontal portion 21*a* of the support member 21 by inorganic bonding agent.

Metal-made Support

The metal-made support 24 is formed of a metal plate of an electric conductive property, and has a generally L-shaped form as viewed from the side. The member 24 comprises a tubular base portion 25 adapted to be fitted on the front end portion of the horizontal portion 21*a* of the support member 21, and a vertically extending support portion 26. A generally U-shaped slot is formed in the portion 26 such that a supporting piece 27 is formed by bending upward the portion surrounded by the U-shaped slot. The supporting piece 27 and the upper end portion of the support portion 26 cooperate to define a generally U-shaped mounting groove 28.

When the metal-made support 24 is mounted on the horizontal portion 21*a* of the support member 21 and the attitude and the position of the support 24 are properly adjusted, the support 24 is secured to the portion 21*a* by such as spot welding, which is preferably performed in mounting the lamp 2 on the support members 20 and 21.

Shade

The shade 29 comprises a generally semi-tubular shade portion 30 and a semi-circular front wall 31 closing the front end of the shade portion 30. A groove 32 is formed in the central portion of the inner surface of the shade portion 30 and has a generally semi-circular section, and an opening 33 is formed in the front wall 30. A shallow cutout 30*a* is formed in the right side upper edge of the shade portion 30 as viewed from the rear.

The shade 29 is mounted on the lamp base 9 with the rear end surface of the shade 29 abutting with the front surface of the lamp holding portion 10, the lower half of the insulating tube 23 fitting in the groove 32 of the shade 29, and the front end of longer or lower support member 21 being fitted in the opening 33 in the front wall 31 of the shade 29. The shade 29 is secured to the lamp base 9 by inorganic bonding agent.

Mounting the Discharge Lamp

The rear lead wire 7 of the lamp 2 is bent upward as shown in FIGS. 1 and 2 to form a vertical portion 7*a* so as to contact with the horizontal portion 20*a* of the upper support member 20. The front lead wire 7 of the lamp 2 is inserted into the mounting groove 28 in the metal-made support 24. At this condition, the location of the lamp 2 is adjusted by moving the lamp 2. When the adjustment has been made, the vertical portion 7*a* of the rear lead wire 7 is secured to the horizontal portion 20*a* of the upper support member 20 and the front lead wire 7 is secured to the metal-made support 24 by such as spot welding process respectively.

The shade portion 30 of the shade 29 is located to cover the lower half portion of the discharge space 3. It will be understood that the front wall 31 of the shade 29 may be omitted. In such case, a shade covering the front side of the lamp 2 is preferably mounted on a reflector and the like associated with the discharge lamp assembly.

Figure 5:
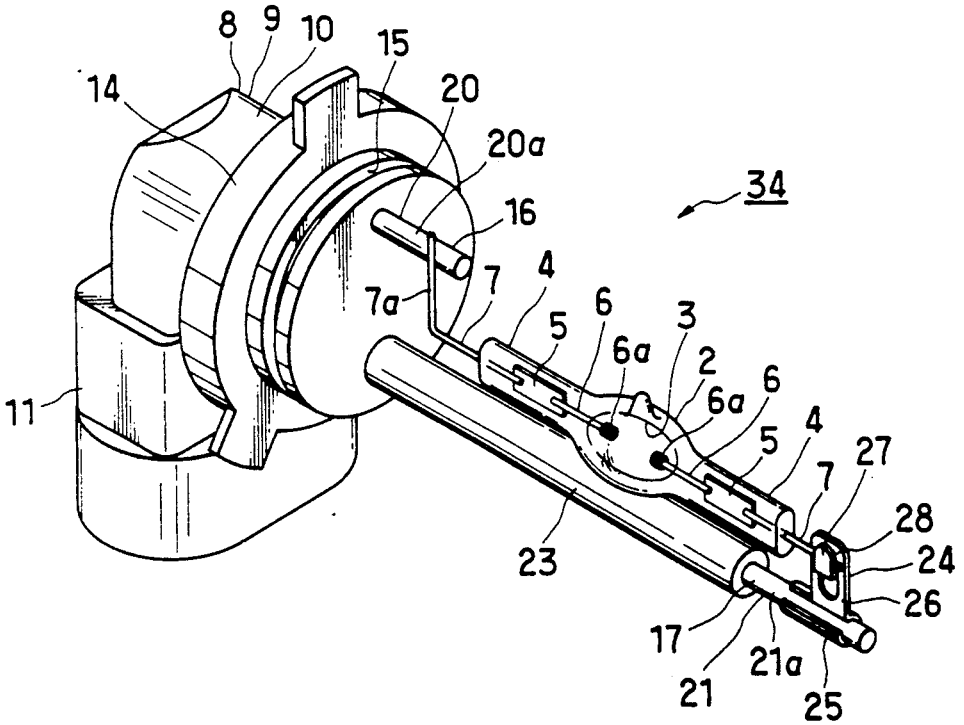
FIG. 5 is a perspective view of an electric discharge lamp assembly according to a second embodiment of the present invention.
Figure 6:
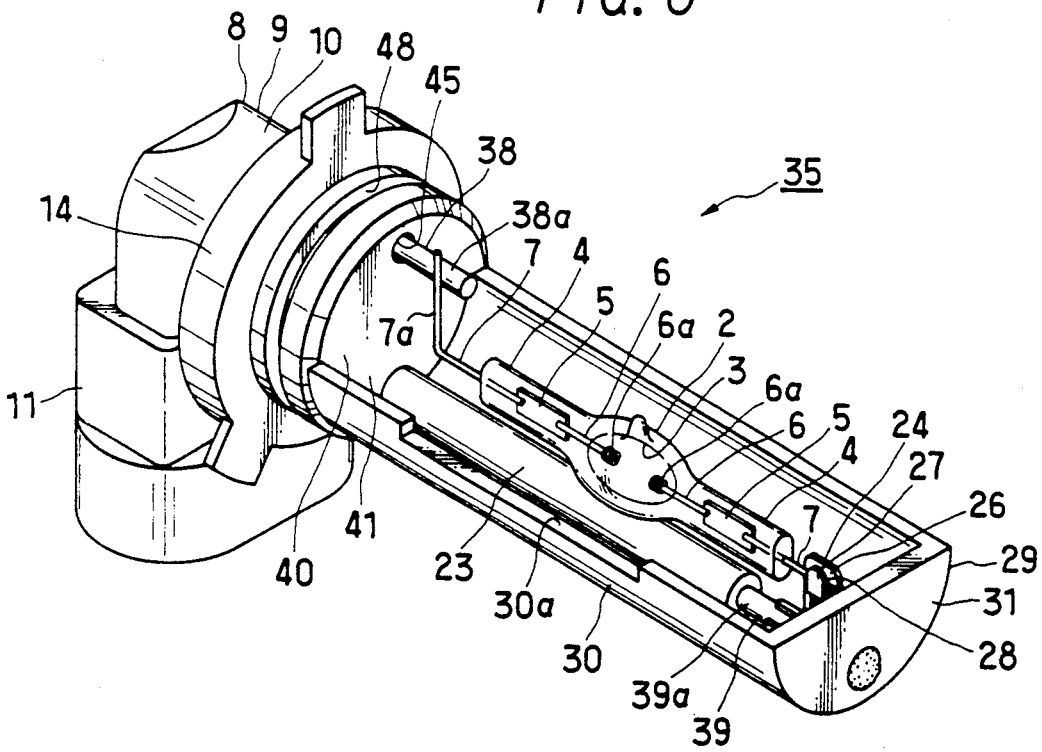
FIG. 6 is a perspective view of an electric discharge lamp assembly according to a third embodiment of the present invention.
Figure 7:
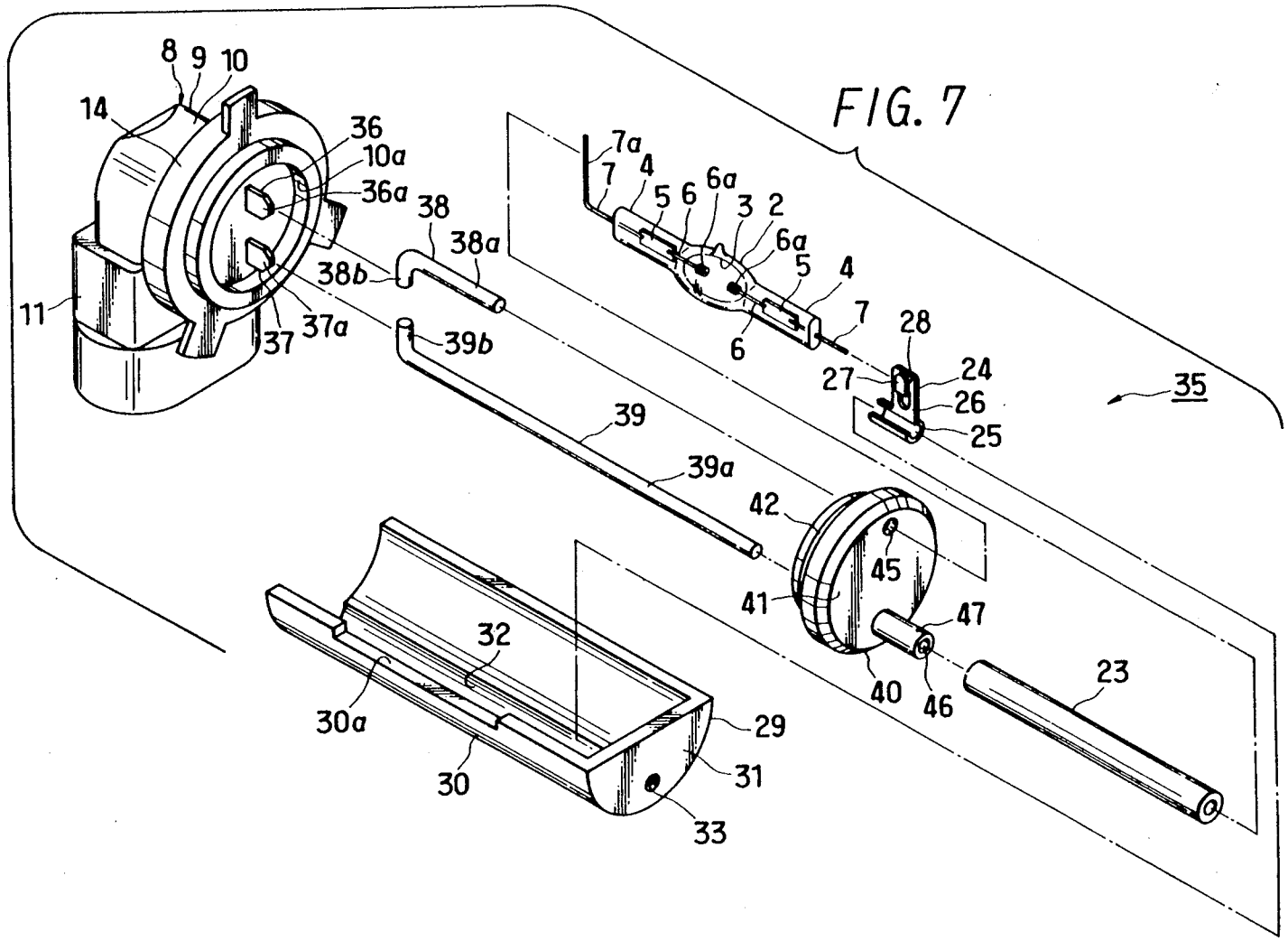
FIG. 7 is an exploded perspective view of FIG. 6.
Figure 8:
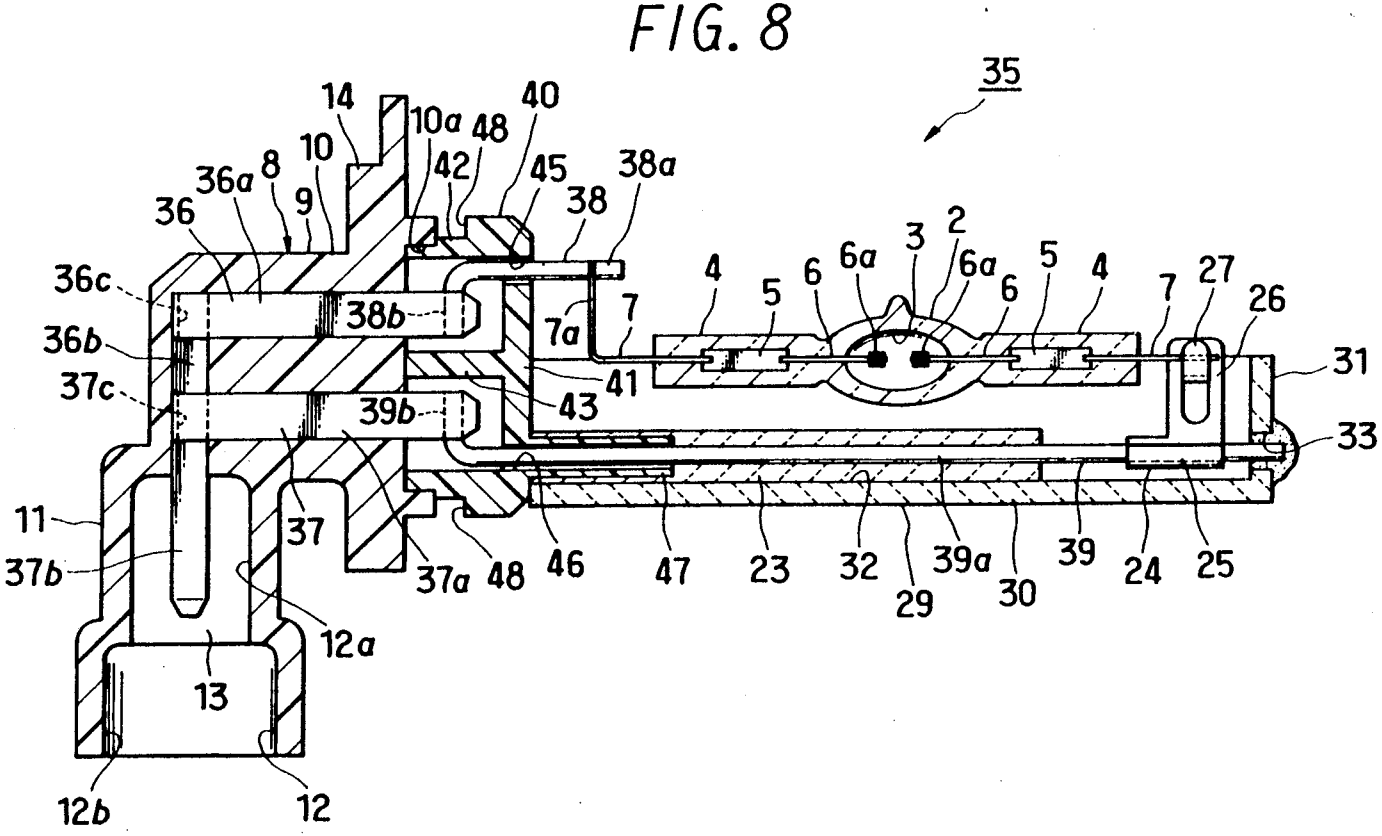
FIG. 8 is a longitudinal section view of FIG. 6.

Second Embodiment (FIG. 5)

FIG. 5 shows a discharge lamp assembly 34 according to the second embodiment of the present invention which is generally similar to the first embodiment although the shade 29 is omitted, thus, the same reference numerals are applied to corresponding parts and the description is omitted.

Third Embodiment (FIG. 6~FIG. 9)

FIG. 6 through FIG. 9 show a discharge lamp assembly 35 according to the third embodiment of the invention which is generally similar to the first embodiment, thus, the same reference numerals are applied to corresponding parts and detailed description is omitted.

The lamp assembly 35 differs from the lamp assembly 1 in that the terminal members consist respectively of embedded portions and separate support members.

Embedded Portions

Shown at 36 and 37 are embedded portions generally having laid down L-shaped form as viewed from the side. The embedded portions 36 and 37 have horizontal portions 36*a* and 37*a* extending in fore and aft directions, vertical portions 36*b* and 37*b* extending in vertical directions and intermediate portions 36*c* and 37*c* connecting the rear ends of the horizontal portions 36*a* and 37*a* with the upper ends of the vertical portions 36*b* and 37*b* respectively. The embedded portions 36 and 37 are respectively formed integrally of metal material having electric conductive property.

The intermediate portions 36*c* and 37*c* respectively extend in the left and right directions and, as viewed from the rear, the right end of the intermediate portion 36*c* is connected to the rear end of the horizontal portion 36*a* and the left end of the intermediate portion 36*c* is connected to the upper end of the vertical portion 36*b*. Similarly, the left end of the intermediate portion 37*c* is connected to the rear end of horizontal portion 37*a* and the right end of intermediate portion 37*c* is connected to upper end of the vertical portion 37*b*. The embedded portions 36 and 37 are embedded in the lamp base 9 by such as insert forming process, with the front ends of the horizontal portions 36*a* and 37*a* projecting from the front surface of the lamp base 9 and the lower ends of the vertical portions 36*b* and 37*b* projecting in the upper portion 12*a* of the recess 12 in the connector portion 11.

The horizontal portions 36*a* and 37*a* are generally aligned in the vertical directions and spaced from each other, and the vertical portions 36*b* and 37*b* are spaced in left and right directions.

Support Member

Shown at 38 and 39 are respectively support members formed of electric conductive metal integrally, and have respectively horizontal portions 38*a* and 39*a* extending in fore and aft directions and vertical portions 38*b* and 39*b* extending in vertical directions. The length of the horizontal portion 38*a* is about $\frac{1}{4}\sim 1/5$ of that of the horizontal portion 39*a*. The vertical portion 38*b* extends downward from the rear end of the horizontal portion 38*a* and, the vertical portion 39*b* extends upward from the rear end of the horizontal portion 39*a*.

The vertical portion 38*b* of the support member 38 is welded to the front end of the horizontal portion 36*a* of the embedded portion 36, and the vertical portion 39*b* of the support member 39 is welded to the front end of the horizontal portion 37*a* of the embedded portion 37, thus, the horizontal portions 38*a* and 39*a* of support members 38 and 39 project respectively from the front surface of the lamp holding portion 10 of the lamp base 9 and are connected with embedded portions 36 and 37 respectively and independently.

Cover Member

Figure 9:
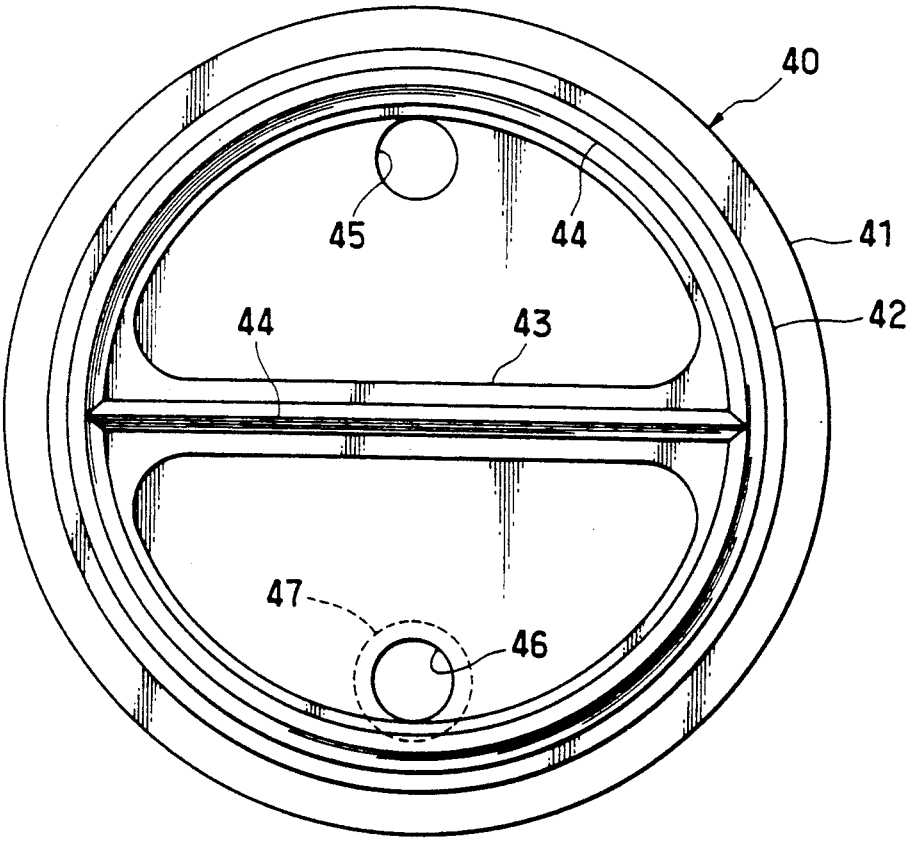
FIG. 9 is an enlarged rear view of a cover member of the embodiment of FIG. 6.

Shown at 40 is a cover member being formed preferably of a synthetic resin material same to that of the lamp base 9. The cover member 40 consists of a main body 41 of a generally circular disc shape with the size same to that of the lamp holding portion 10 of the lamp base 9, an annular peripheral wall 42 projecting in the rear direction from the outer periphery of the main body 41, and a partition wall 43 which partitions the annular space defined by the peripheral wall 42 into an upper and lower spaces. Welding projections or ridges 44 and 44 are formed on the rear end surfaces of the peripheral wall 42 and the partition wall 43 having generally triangular cross-section respectively as shown in FIG. 9. Openings 45 and 46 are formed in the main body 41 for passing through respectively the support members 38 and 39.

Shown at 47 is a tubular portion integrally formed on the main body portion 41 to project forward from the front surface of the main body portion 41 and around the periphery of the opening 46.

The horizontal portion 38*a* of the upper support member 38 is inserted through the opening 45 in the main body portion 41 of the cover 40, and the horizontal portion 39*a* of the lower support member 39 is inserted through the opening 46 in the main body portion 41 of the cover 40 and through the tubular portion 47. Further, the rear end portion of the peripheral wall 42 of the cover 40 is fitted in the shallow recess 10*a* in the front surface of the lamp holding portion 10 of the lamp base 9. At this condition, the rear end of the peripheral wall portion 42 and the rear end of the partition wall 43 are secured to the front surface of the lamp holding portion 10 of the lamp base 9 by such as super sonic welding.

The rear end portion of the insulating tube 23 is fitted on and secured to the tubular portion 47 of the cover 40.

A fitting groove 48 for receiving a packing is formed between the outer periphery of the main portion 41 of the cover 40 and the front outer periphery of the lamp holding portion 10 of the lamp base 9.

Figure 10:
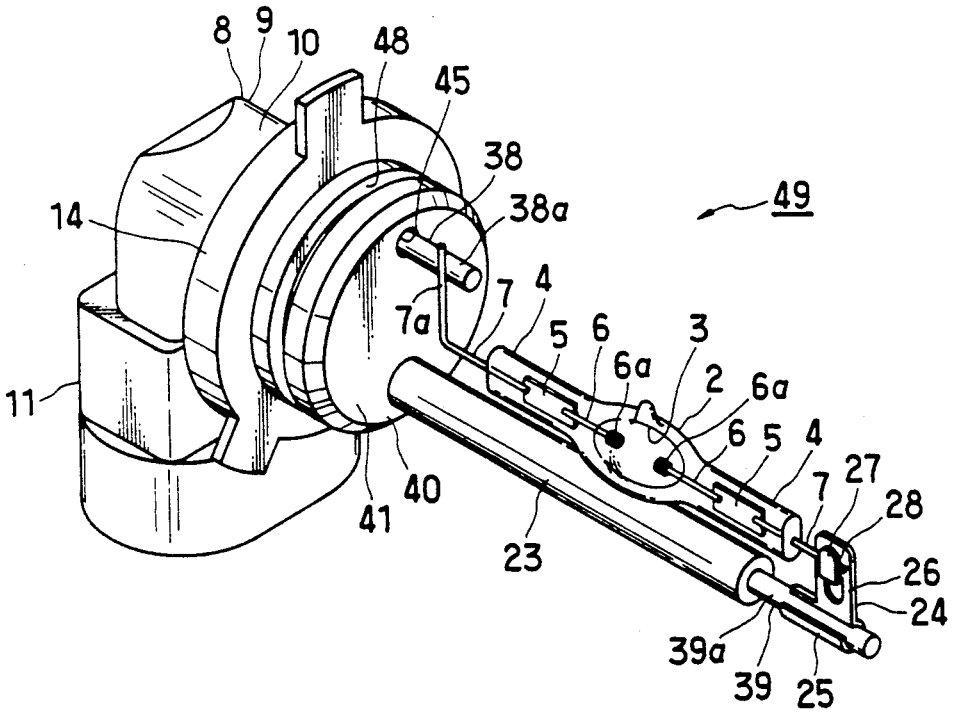
FIG. 10 is a perspective view of an electric discharge lamp assembly according to a fourth embodiment of the present invention.
Figure 11:
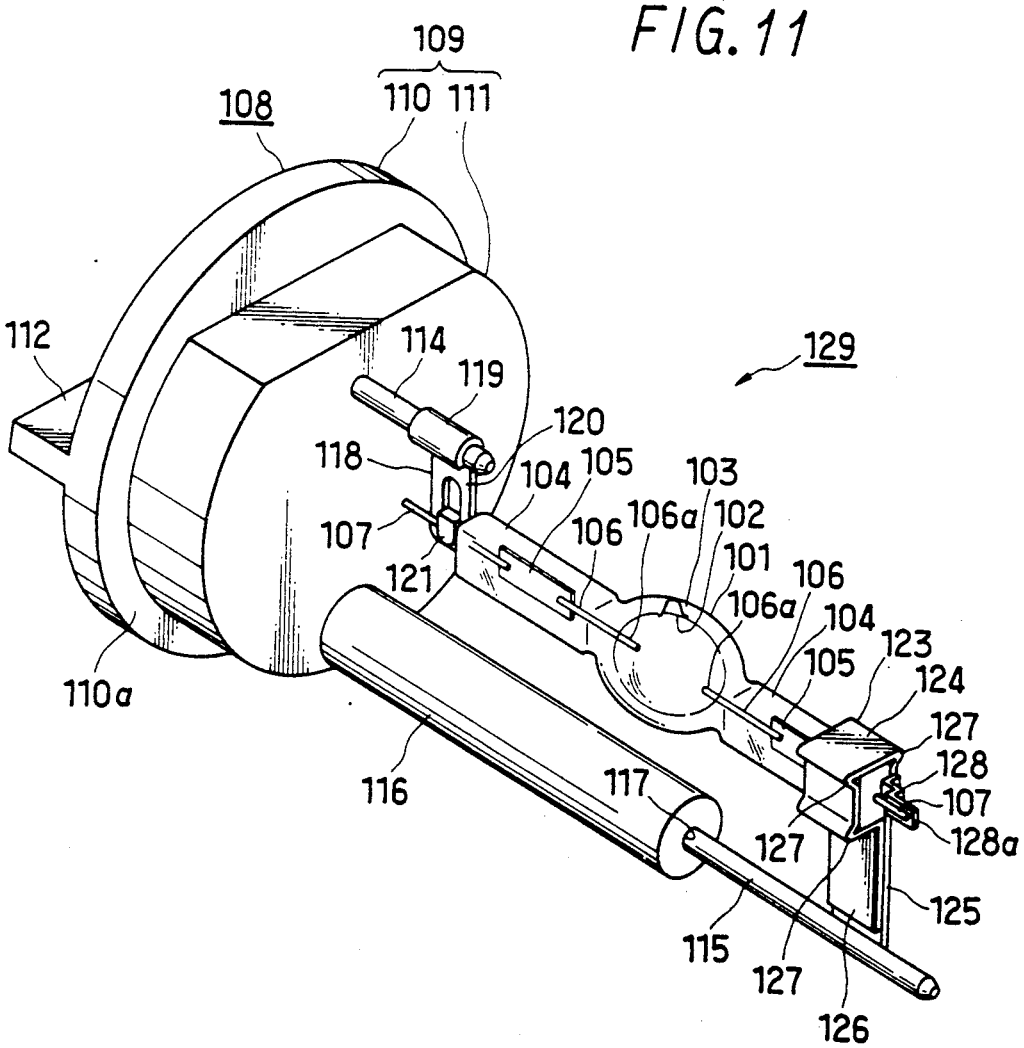
FIG. 11 is a perspective view of an electric discharge lamp assembly according to a fifth embodiment of the present invention.

Fourth Embodiment (FIG. 10)

An electric discharge lamp assembly 49 shown in FIG. 10 is similar to the third embodiment shown in FIG. 6~FIG. 9, but the shade 29 is omitted.

Fifth Embodiment (FIG. 11~FIG. 16)

An electric discharge lamp assembly 129 according to the fifth embodiment of the present invention and shown in FIG. 11~FIG. 16 comprises essentially a metal halide discharge lamp 102 and lamp mounting means 108.

Discharge Lamp

The discharge lamp 102 is generally similar to the discharge lamp 2 shown in the preceding embodiments and, accordingly, corresponding parts are denoted by the same reference numerals added by 100 and the description is omitted.

Lamp Mounting Means

The lamp mounting means 108 comprises a lamp base 109, lead supporting members 114 and 115, a sleeve 116, metal-made support member 118 and a metal band 123.

Lamp Base

The lamp base 109 consists of a generally disc shaped base portion 110 and a projecting portion 111 integrally projecting from the front surface of the base portion 110. The portion 111 has a diameter smaller than that of the base portion 110 and a larger thickness and, the upper edge of the circular disc is cut off as shown in the drawings. The portions 110 and 111 are co-axial with each other, thus, the outer circumferential portion 110*a* of the portion 110 constitutes a flange.

A ridge or a partition wall 112 is formed integrally on the rear surface of the base portion 110 to extend horizontally.

Figure 12:
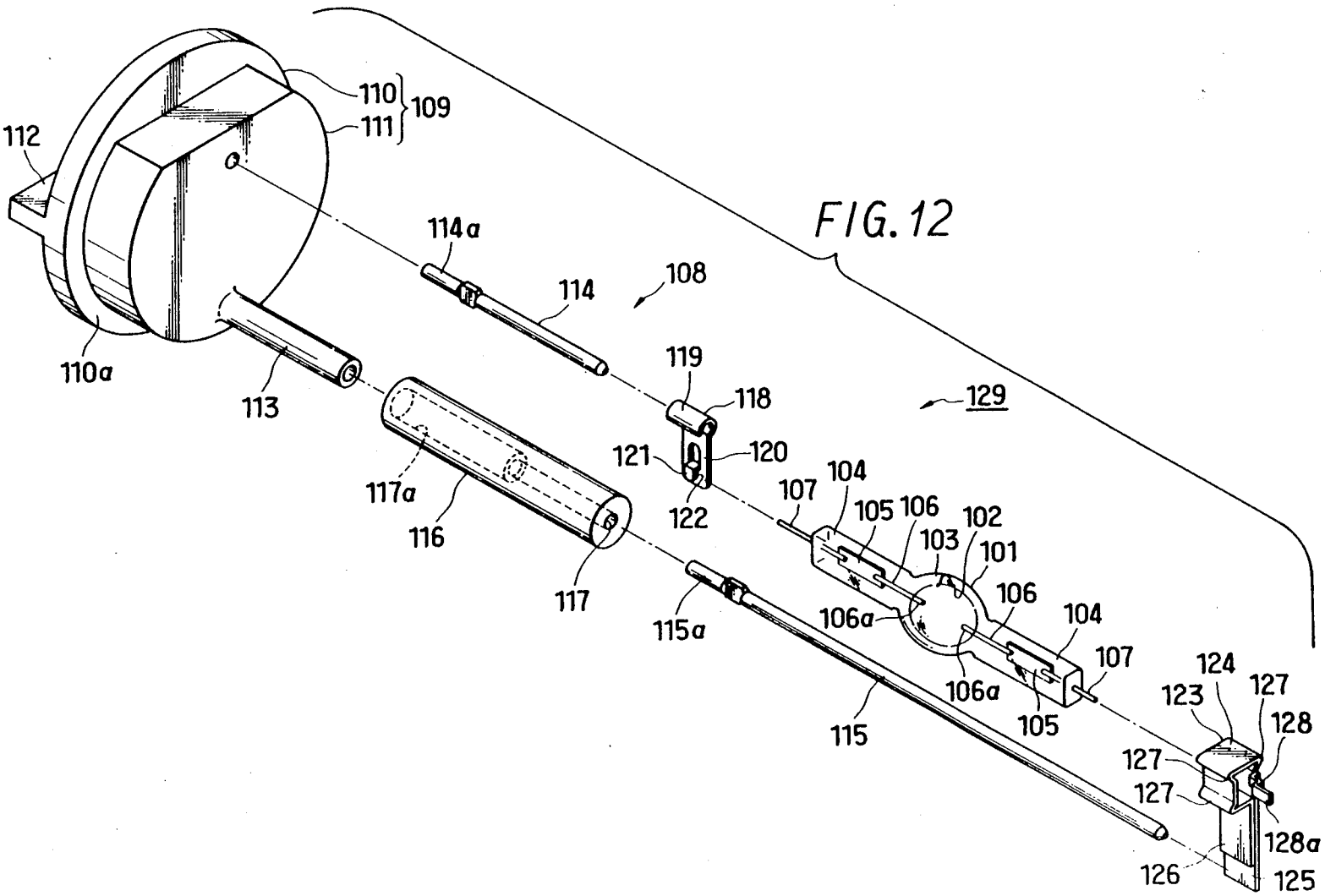
FIG. 12 is an exploded perspective view of the lamp assembly of FIG. 11.
Figure 13:
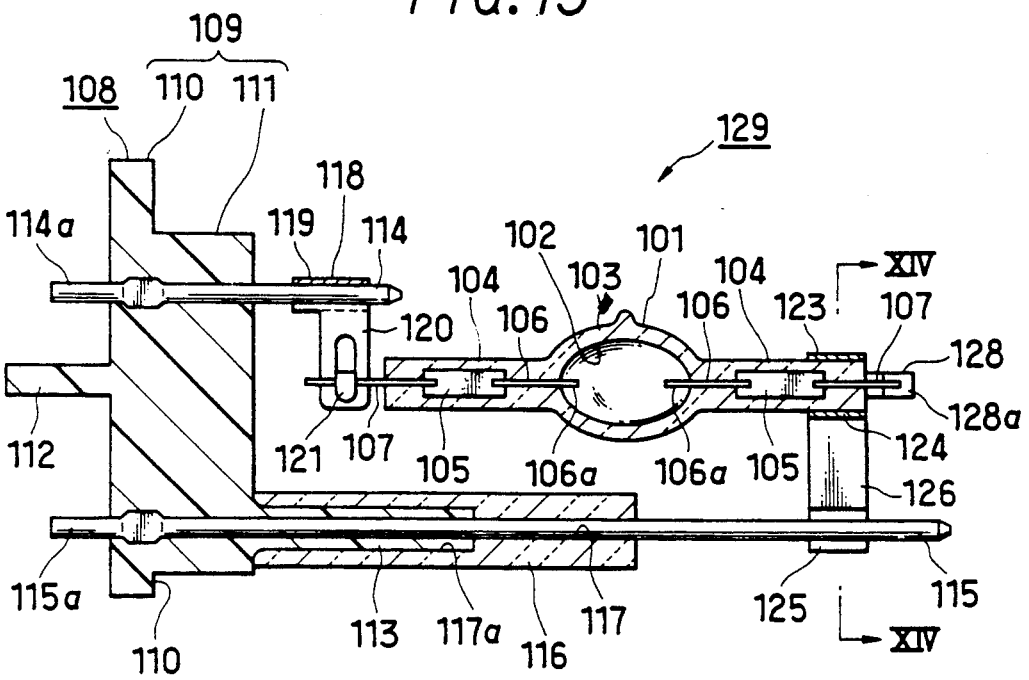
FIG. 13 is a partially broken away side view of the lamp assembly of FIG. 11.
Figure 14:
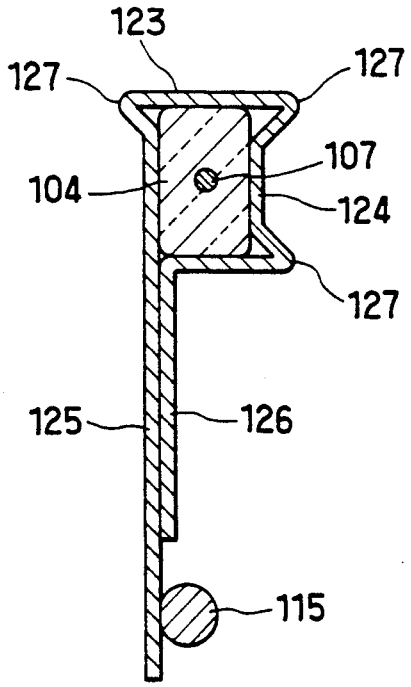
FIG. 14 is an enlarged section view taken along line XIV—XIV in FIG. 13.

Further, a connecting tube 113 is integrally formed on the front surface of the projecting portion 111 as shown in FIGS. 12 and 13.

Lead Support Members

The lead support members 114 and 115 consist of a long member 115 and a short member 114, with the length of the shorter one 114 is about 2/5 of the longer member 115. The member 114 passes through the socket main body 109 at the location near to the upper edge, and the lead support member 115 passes through the socket main body 109 at the location where the connecting tube 113 is provided, thus passes through the connecting tube 113.

The rear ends 114*a* and 115*a* of the members 114 and 115 project from the rear surface of the socket main body 109 by a same amount which is slightly shorter than that of the wall 112 as shown in FIG. 13. The projecting ends 114*a* and 115*a* of the members 114 and 115 constitute the terminals through which the electric power is supplied to the discharge lamp assembly 129.

The lead support member 114 project from the front surface of the portion 111 by an amount of about 1/5 of that of the member 115.

The lead support members 114 and 115 are formed of an electric conductive material such as a metal and are formed integrally with the socket main body 109 by such as insert forming process.

Insulating Sleeve

The sleeve 116 is formed of an insulating material such as a ceramic and has a tubular form extending in fore and aft directions. A bore 117 consisting of a large diameter rear half portion 117*a* and a front small diameter portion is formed in the sleeve 116. The rear portion 117*a* corresponds to the connecting tube 113 and the front portion of the bore 117 corresponds to the lead support member 115. The sleeve 116 is secured to the connecting tube 113, the socket main body 109 and to the lead support member 115 by such as inorganic bonding agent and the like.

Metal-Made Support Member

The metal-made support member 118 is preferably formed of an electric conductive metal plate and, has a tubular base portion 119 adapted to be mounted on the front end portion of the lead support member 114 and a downward extending support portion 120. A generally inverted U-shaped slot is formed in the support portion 120 and an area surrounded by the slot is bent downward to form a support piece 121 which cooperates with the portion 120 to define an inverted U-shaped mounting groove 122 therebetween. The mounting groove 122 is adapted to be connected to the lead wire 107 which extends from the rear end of the discharge lamp 102.

The metal-made support member 118 is secured to the lead support member 114 and to the lead wire 107 of the discharge lamp 102 by such as spot welding after the position and attitude of the discharge lamp 102 has been properly adjusted.

Metal Band

The metal band 123 is formed of an electric conductive metal plate. The band 123 consists integrally of a twine portion 124 having a generally rectangular shape as viewed in fore and aft directions, and leg portions 125 and 126 which extend downward from opposite ends of the twine portion 124. The leg portion 125 is slightly longer than the leg portion 126.

Shown at 127, 127 and 127 are three corners of the rectangular of the twine portion 124 which project outward thereby causing the resiliency of the portion 124. Thus, when the twine portion 124 is twined around the periphery of the pinch seal portion 104 of the lamp 102 the metal band 123 resiliently hold the lamp 102.

Shown at 128 is a connecting piece integrally formed on the twine portion 124 to extend generally along the lead wire 107.

The metal band 123 is secured to the long lead support 115 and to the front lead wire 107 by spot welding and the like after the position and attitude of the lamp 102 has been properly adjusted. The welding is made between the lower end of the longer leg portion 125 and the lead support 115 and between the front end portion 128*a* of the connecting piece 128 and the front lead wire 107.

Figure 15:
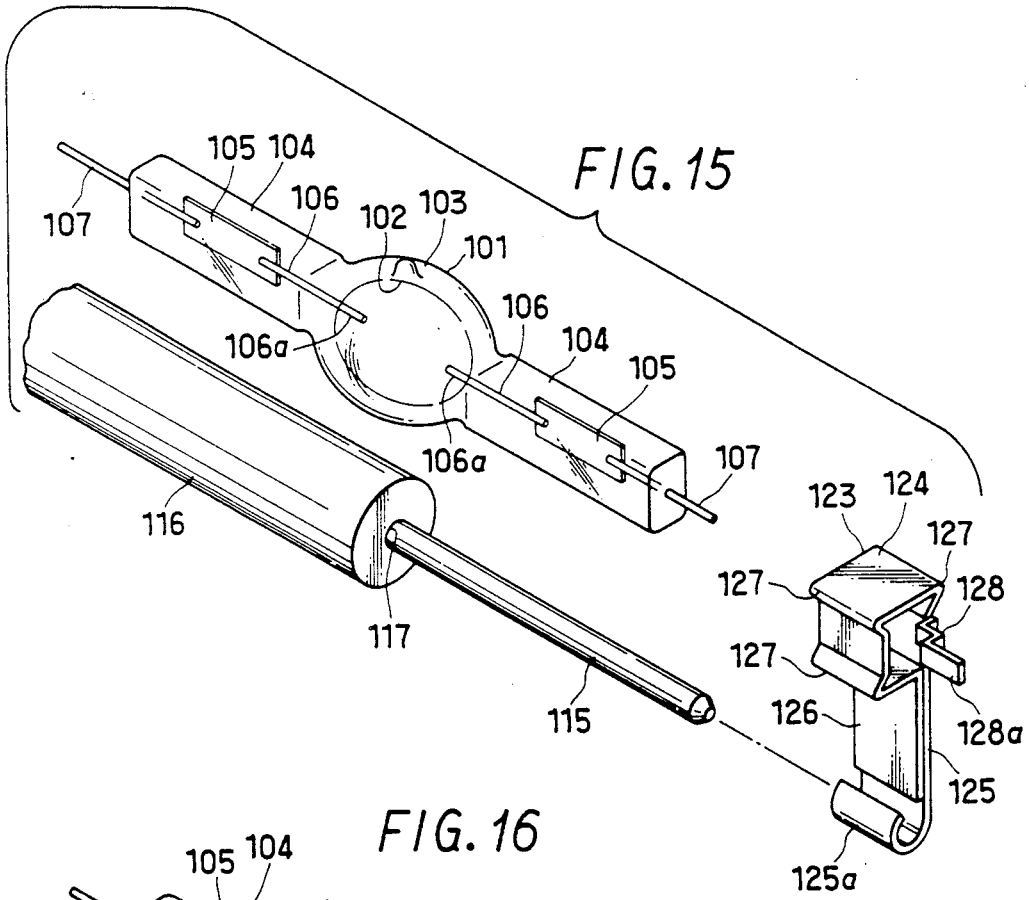
FIG. 15 is an enlarged exploded perspective view of an essential portion of an embodiment modified from the embodiment of FIG. 11.
Figure 16:
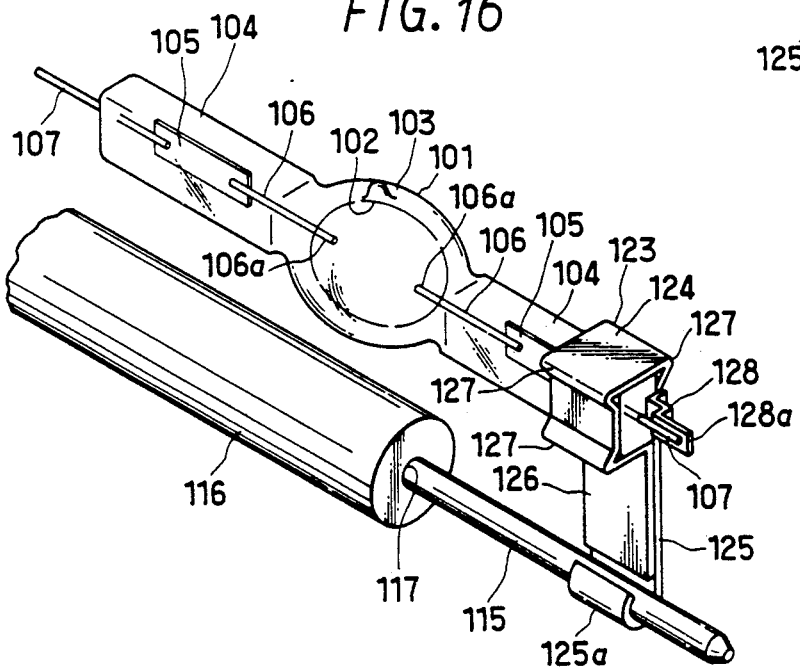
FIG. 16 is an enlarged perspective view of FIG. 15 in an assembled condition.

Modified Form (FIGS. 15 and 16)

FIGS. 15 and 16 show a modified form of the fifth embodiment of the invention, wherein the lower end 125*a* of the longer leg portion 125 is bent to fit with the lead support 115.

Figure 17:
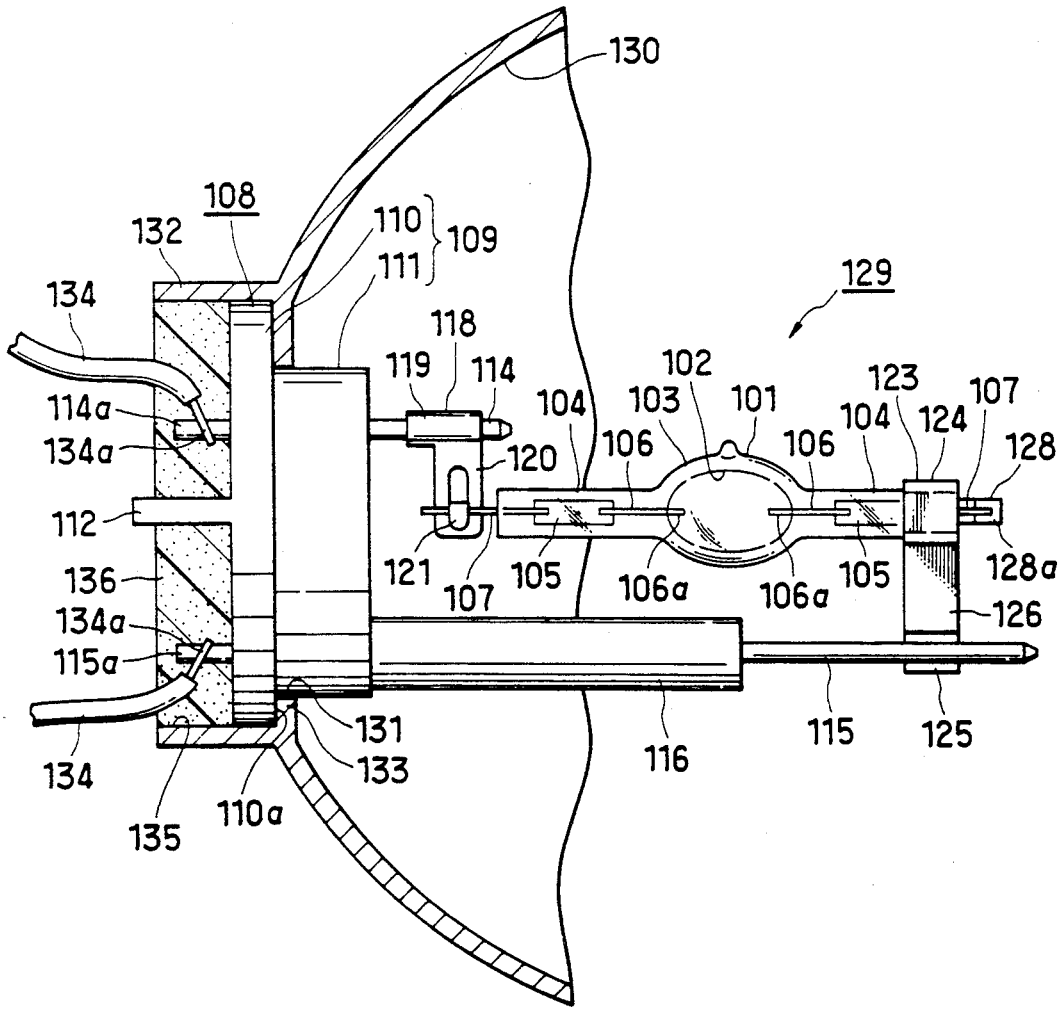
FIG. 17 is a schematic view showing the electric discharge assembly of FIG. 11 as applied on a headlight of an automobile.

Example of Utilization (FIG. 17)

FIG. 17 shows an example of utilization of the electric discharge lamp assembly.

Shown at 130 is a reflective mirror of an automobile headlight and, is formed to have a lamp mounting opening 131 in the rear central portion and an annular mounting portion 132.

The discharge lamp assembly 129 is mounted through the opening 131 from the rear. The base portion 110 is fitted in the mounting portion 132. The outer peripheral portion 110*a* of the base portion 110 abuts with the rear surface of a flange portion 133 which is defined by the difference in the diameter of the mounting portion 132 and the mounting opening 131. Shown at 134 and 134 are electric cords connected to a discharge circuit (not shown) and respective tip ends 134*a* and 134*a* thereof are connected to terminal portions 114*a* and 115*a*.

The axial length of the annular mounting portion 132 is about twice of the thickness of the base portion 110 so as to define a recess on the rear surface of the base portion 110. The recess is filled with a bonding agent and is solidified. The lamp assembly 129 is reliably mounted on the reflective mirror 130 and the electric discharge between the terminals 114*a* and 115*a* is reliably prevented.

Advantage of the Invention

As described heretofore, in the electric discharge lamp assembly according to the invention, the rear end of the longer lead support member projecting from the front surface of the lamp base is covered by a tubular portion which is integrally formed with the lamp base and projects from the front surface of the lamp base, and the tubular portion and the longer lead support member are fitted in and covered by a separate tubular insulating member and secured thereto through a bonding agent, thus, the electric discharge between the longer and shorter lead support members can effectively be prevented. The tubular insulating member can be formed of any suitable material having a superior insulating property such as a ceramic or glass, while the lamp base is preferably formed of a synthetic resin material, thus, it is possible to improve substantially the insulating characteristics. Futher, since the tubular member is fitted on and secured to the tubular portion which is formed integral with the lamp base, the mounting of the tubular member on the lamp base is reliable which assures an extended service life.

Further, according to one feature of the invention, the length of the tubular portion of the lamp base and projecting from the front surface of the lamp base is longer than that of the shorter lead support member, the electric discharge between the longer and shorter lead support members can further be prevented.

Further, according to one feature of the present invention, the discharge lamp is mounted on a lead support member through a metal band which twines the pinch seal portion of the lamp, thus, the anti-vibration property of the lamp assembly is improved substantially.

Although the description has been made with respect to preferred embodiments, it will be understood that the invention is not limited to the embodiments and various changes or modifications can easily be made for those skilled in the art.

We claim:

1. An electric discharge lamp assembly including a lamp bulb having two lead wires, two lead support members, a lamp base supporting said two lead support members with respective tip ends of said two lead support members being connected to respective lead wires of the lamp bulb, said lamp base including an integrally formed tubular portion, an insulating tubular member, one of the lead support members having an elongated length and being substantially covered by said insulating tubular member, the rear end portion of the tubular member being fitted around and secured to said tubular portion of the lamp base, whereby electric discharge between the two support members is prevented effectively and the insulating tubular member is secured to the lamp base reliably, and a metal band wound around a pinch seal portion of said bulb and secured to said lead support member of elongated length and to a one of said lead wires associated with said pinch seal portion.

2. An electric discharge lamp assembly according to claim 1, wherein the tubular insulating member is formed of a good insulating material such as glass or ceramic.

3. An electric discharge lamp assembly according to claim 1, wherein the tubular insulating member and the tubular portion of the lamp base are secured together by an inorganic bonding agent.

4. An electric discharge lamp assembly according to claim 1, wherein the length of the tubular portion of the lamp base and projecting from the front surface of the lamp base is longer than that of the shorter lead support member.

5. An electric discharge lamp assembly according to claim 1, wherein one end of said metal band connected to the associated with said lead support member is shaped to fit on the lead support member.

6. An electric discharge lamp assembly according to claim 1, wherein a resiliently deformable portion is formed in the metal band so as to compensate a misalignment between the lamp bulb and the lead support member and to absorb vibrations.

* * * * *